United States Patent [19]

Bock et al.

[11] Patent Number: 4,730,784

[45] Date of Patent: Mar. 15, 1988

[54] OXYGEN BLAST NOZZLE

[75] Inventors: André Bock, Luxembourg; Romain Henrion; Jean Liesch, both of Esch/Alzette; Carlo Heintz, Luxembourg; Henri Klein, Niedercorn; Jean-François Liesch, Esch/Alzette, all of Luxembourg

[73] Assignee: Arbed S.A., Luxembourg, Luxembourg

[21] Appl. No.: 17,763

[22] Filed: Feb. 20, 1987

[30] Foreign Application Priority Data

Feb. 25, 1986 [LU] Luxembourg ..... 86322

[51] Int. Cl.[4] ..... B05B 7/12

[52] U.S. Cl. ..... 239/416.4; 239/416.5; 239/417.3; 239/434.5; 266/217; 266/266; 75/59.12

[58] Field of Search ..... 239/433, 419, 416.4, 239/416.5, 290, 417.3, 413, 434.5; 75/92, 59.13, 59.11, 59.12; 266/265, 266, 267, 44, 47, 217, 225

[56] References Cited

U.S. PATENT DOCUMENTS

| | | | |
|---|---|---|---|
| 736,473 | 8/1903 | Arnold | 239/417.3 |
| 2,746,802 | 5/1956 | Feis | 239/434.5 |
| 4,022,447 | 5/1977 | Griffiths | 266/266 |
| 4,630,802 | 12/1986 | Frykendahl | 266/225 |

FOREIGN PATENT DOCUMENTS

| | | | |
|---|---|---|---|
| 667190 | 7/1965 | Belgium | 266/265 |
| 2108856 | 5/1972 | France | 266/267 |

*Primary Examiner*—Andres Kashnikow
*Assistant Examiner*—Chris Trainor
*Attorney, Agent, or Firm*—Fishman & Dionne

[57] ABSTRACT

A nozzle for the refining of metals by oxygen blasting from above the melt is presented. The nozzle includes a nozzle head having a blast pipe therethrough upstream of the mouth of the nozzle. The blast pipe directs a jet of gas comprised, at least in part, of oxygen, having a supersonic speed onto the melt. The blast pipe includes an inner tube. The lower portion of the inner tube has a throat positioned between a convergent and divergent sections, this lower portion defining a laval nozzle. The blast pipe also includes an outer tube coaxial with the inner tube and having a greater cross section than the inner tube. The mouth of the inner tube is spaced back (downstream) from the mouth of the blast pipe. The inner and outer tubes are each provided with flow control valves, and are connected to sources of pressurized gas. Devices are provided to vary the cross sectional area of the mouth of the inner tube. This device may consist of a needle shaped member, displaceable along the longitudinal axis of the inner tube, with the pointed portion of the needle movable between different positions within the convergent section of the inner tube.

10 Claims, 4 Drawing Figures

OXYGEN BLAST NOZZLE

BACKGROUND OF THE INVENTION

This invention relates to a nozzle for the refining of metals or ferroalloys by blasts of oxygen from above the melt.

The design of an oxygen blast nozzle necessitates certain computations which must take into account the following two quantities: the Mach number, and the optimum flow rate. This is regardless of whether the nozzle delivers a vertical jet for the refining operation itself; or the nozzle includes additional oblique jets for after combustion of carbon monoxide.

The Mach number is a quantity which expresses the impulse, the velocity or the intensity of the jet. The blast pipe of a nozzle usually includes a convergent portion and a divergent portion downstream of the convergent section. The Mach number is a function of the ratio of the diameters of the outlet of the divergent section and the throat of the convergent section. The optimum flow rate is a function of the inlet pressure to the blast pipe and the diameter of the throat of the convergent section.

It has been found that these two quantities depend upon the geometric configuration of the blast pipe; and do not vary independently of one another. This implies that it is not possible to effect blasting with an intense jet and reduced flow using a nozzle designed to have a large optimal flow; nor to effect blasting with a soft jet and reduced flow using a nozzle designed to have a large flow, without moving in one direction or the other away from the optimal quantities linked to the geometric configuration of the blast pipe. However, if it is attempted to exceed the limits (with respect to the flow rate and outlet speed), within the converter, just outside the mouth of the nozzle, shock waves are created. The characteristics of the jet are degraded, and nozzle wear is accelerated.

The metallurgist may wish to project onto the bath in the refining path a soft vertical jet, with a high flow rate. Such a manner of blasting is desirable in refining when a greatly oxidized slag is to be formed. It will also be appreciated that there could be a need to blast with an intense vertical jet at a reduced flow rate. This procedure would be indicated in order to reduce the total volume of oxygen supplied to the converter, so as not to oxidize the slag while at the same time ensuring a vigorous decarbonization of the metal.

SUMMARY OF THE INVENTION

The above-described and other drawbacks and deficiencies of the prior art are overcome or alleviated by the oxygen blasting nozzle of the present invention. In accordance with the present invention, a blasting nozzle is provided which makes it possible to vary the Mach number and the flow rate independently of one another, utilizing a minimum number of moving parts.

An essential feature of the present invention is the utilization of a minimum number of mechanical means, that is, it is necessary to reach the desired objective without having to use mechanical means capable of varying the geometric configuration of the outlet of the blast pipe. This is because, from a practicle standpoint, mechanical means enabling variation of the divergence of a blast pipe are not available at an acceptable cost.

The nozzle for refining metals in accordance with the present invention includes a nozzle head, terminating at a mouth. Downstream of the mouth is a blast pipe for directing a jet of gas composed, at least in part, of oxygen, having a supersonic speed. The blast pipe includes an inner tube and an outer tube coaxial with the inner tube, and having a greater cross section than the inner tube. The lower portion of the inner tube has a throat positioned between a convergent and divergent sections, this lower portion defining a laval nozzle. The mouth of the inner tube is spaced back (downstream) from the mouth of the blast pipe. The inner and outer tubes are each provided with flow control valves and are connected to sources of gas under pressure. Means are provided to change the area of the mouth of the inner tube. Preferably, such means comprise a needle shaped member, displaceable along the axis of the inner tube, with the pointed portion of the needle movable between different positions within the convergent section of the inner tube.

A main advantage of the present invention is the ability which it offers to the steelmaker, to vary, as a function of the various phases of refining, the quantity of oxygen introduced into the bath while at the same time always providing the jet with the requisite optimal velocity.

The above-described and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
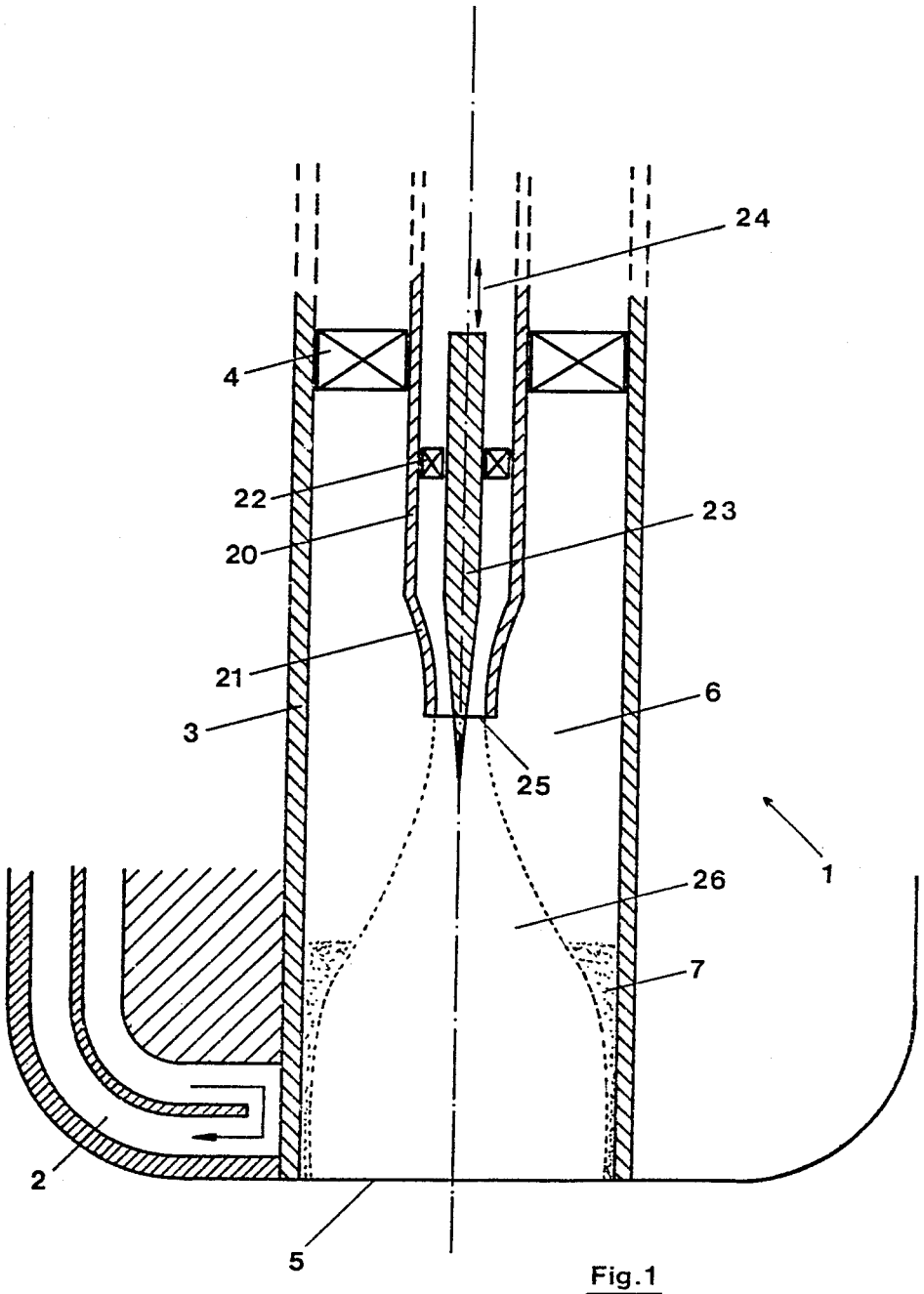
FIG. 1 is a cross sectional elevation view of a first embodiment of a nozzle in accordance with the present invention.

In FIG. 1, a portion of a nozzle head having an internal water-cooling system 2 is shown. A blast pipe shown generally at 1 for supplying refining oxygen is composed of an essentially cylindrical inner tube 20 having a lower portion 21, and an essentially cylindrical outer tube 3, coaxial to inner tube 20. Lower portion 21 comprises a throat positioned between a convergent section and a divergent section, this lower portion defining a laval nozzle for accelerating gas to supersonic speeds. Preferably, the cross sectional area of inner tube 20 is at least 50% and at most 90% of the cross sectional area of outer tube 3. A mouth 25 of tube 20 is spaced preferably about ten centimeters downstream of a mouth 5 of blast pipe 1. The two tubes 3 and 20 have regulator valves 22 and 4, respectively, enabling individual control of the quantity and pressure of the gas passing therethrough. It will be appreciated that valves 22 and 4 are actually located substantially further upstream from the mouths 25 and 5 (for example, at the level of the mounting supports of the nozzle). Coaxially mounted in tube 20 is longitudinal member 23, preferably in the shape of a needle. Member 23 is movable along the central axis of tube 20, in the direction of the double arrow 24, by means of a motor (not shown), which can be of the linear step motor type. Within tube 3 is a zone 7, where the interaction between the central supersonic gas jet 26 (in expansion) exiting from tube 20, and the annular subsonic gas jet 6 (surrounding the central jet 26) creates conditions equivalent to an effective reduction of the cross section at the outlet of tube 3.

As mentioned, inner tube 20 has, at its outlet, a convergent portion 21, whose effective area is variable because of the adjustable positioning of needle shaped member 23. During operation, refining oxygen is blown through tube 20, whose initial pressure is controlled by means of regulator valve 22. This jet passes through outlet 25 of inner tube 20, with the effective outlet area being determined by the position of needle shaped member 23. The jet thereafter enters outer tube 3. On entering tube 3, jet 26 is expanded.

Outer tube 3 delivers an annular jet 6 of oxygen, or of air, whose flow rate is controlled by means of regulator valve 4. Gas jet 6 envelops the expanded jet 26. Given that complementary expansion phenomena of a supersonic jet and a subsonic jet are exploited, valve 4 must be opened at most only to the position at which annular jet 6 becomes supersonic, otherwise functioning of the blast pipe is no longer ensured. On the other hand, it is important to ensure that the static pressure of the jet exiting from blast pipe 1 is near the pressure within the metallurgical receiver. It will be appreciated that when a supersonic jet leaves a blast pipe which guides it laterally, having an internal pressure greater than the pressure of the ambient medium, there results a lateral expansion of such force that its internal pressure falls below that of the ambient medium, which in turn compresses the supersonic jet. As a result, shock waves form. Note that in the blast pipe of the present invention, this constraint imposed on the outlet pressure of the supersonic jet can be suppressed to a slight degree. Annular subsonic jet 6 continues to envelope supersonic jet 26, and acts as a brake on its transverse expansion.

To better understand the functioning of the present invention, a review of what occurs for one given position of valves 4 and 22 now follows. Needle 23 is retracted so as to increase the effective area of throat 25. The flow of the supersonic jet is increased. At first glance, with regard to the fact that in a Laval tube, with constant initial pressure, the Mach number is a function of the ratio (divergent outlet diameter)/(convergent throat diameter), it could be thought that the gas velocity at the outlet would diminish. In fact, in a very brief first phase, the velocity at the outlet effectively diminishes. Conjointly with the velocity drop, the internal pressure of the supersonic jet increases, which causes an enlargement of the supersonic jet at the expense of the annular subsonic jet, and the velocity of the supersonic gas assumes a value near that observed before alteration of the needle position.

An opening of valve 22, on the other hand, is accompanied by an increase in the flow and velocity of the gas. The initial flow is reestablished by reducing the effective area of throat 25 using needle 23.

It should be noted that the degree of opening of valve 4 is not a variable which can be adjusted at will. Its basic function is to reduce the source pressure so as to exclude the creation of a supersonic annular jet. Given that a subsonic jet, on exiting a duct, possesses an internal pressure equal to that of the ambient medium, there is complete liberty to choose, by means of routine tests, the degree of opening of the valve which, for the range of flows and velocities of the supersonic jet, enables an optimal enlargement and contraction of this jet. Once this valve position has been determined, the zero position of the comparator 40 is set (as described in more detail below with respect to FIG. 2). During different modes of functioning of the nozzle, the degree of opening of valve 4 changes only slightly.

Figure 2:
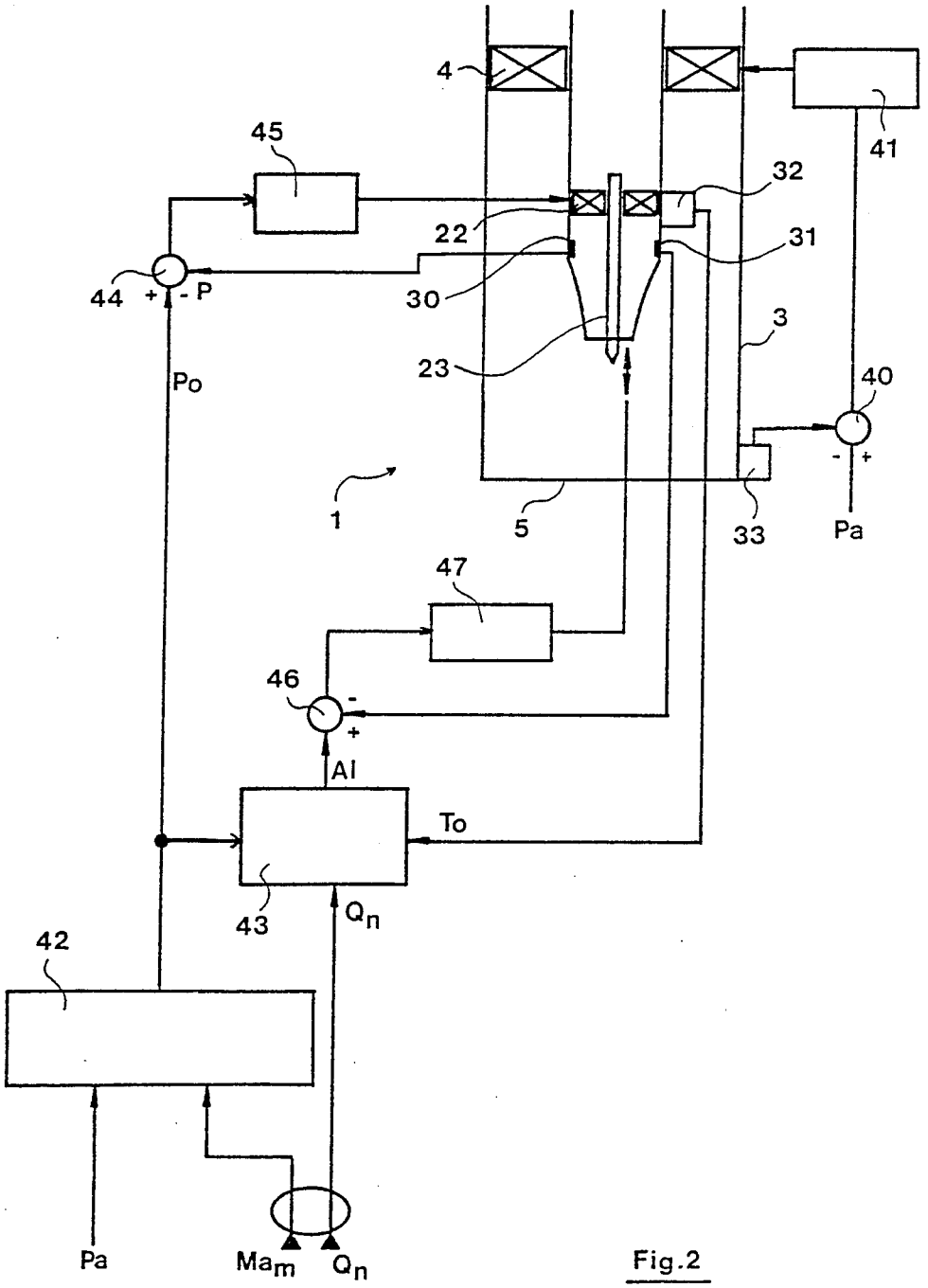
FIG. 2 is a schematic diagram for control of the various elements of the nozzle shown in FIG. 1, permitting individual variability of the Mach number and the optimal flow rate.

The schematic of FIG. 2 is intended to illustrate a process for regulation of the operation of the blast nozzle of the present invention. The driving elements are the regulator valves 22 and 4, as well as the mechanism for moving longitudinal member 23. The measurement elements are a pressure sensor 30, a needle position sensor 31, and a refining oxygen jet temperature sensor 32, all of which are located upstream of convergent portion 21. Another sensor 33 measures the pressure of the jet at mouth 5 of blast pipe 1.

In accordance with known theory of Laval tubes, the following relations are given:

$$P_o = P_a\left(1 + \frac{k-1}{2} \cdot M_{am}^2\right)^{k/k-1} \quad (1)$$

$$A_1 = Q_n \frac{\sqrt{T}}{K} \dot{0} \frac{1}{P_o} \text{ where } K = \frac{\alpha}{\xi_N}\left[\frac{2}{k+1}\right]^{k+1/2(k-1)} \sqrt{\frac{k}{R}} \quad (2)$$

in which:

$P_o$ is the pressure at entry into the Laval tube (pa)

$T_o$ is the temperature at entry into the LavaI tube (°K)

$P_a$ is the pressure at the exit from the Laval tube (pa) (in the present case, the pressure in the converter)

k is equal to the ratio of the mass heat of the gas at constant pressure and its mass heat at constant volume i.e. $C_p/C_v$ $\alpha$ is the coefficient of velocity of the jet, which expresses losses within the blast pipe (ideal case: $\alpha=1$)

$\zeta_N$ is the gas density under normal conditions i.e. 20° C., 1 atmosphere (kg/Nm$^3$)

$Q_n$ is the volume rate of the gas (Nm$^3$/s)

R is the specific constant of the gas ($R=cp-cv$)($J$/kg.°K)

$A_l$ is the effective throat area of the Laval tube (m$^2$)

$M_{am}$ is the Mach number at the mouth.

The two relations (1) and (2) are calculated, respectively, in two function generators 42 and 43. The inputs to generator 42 are the pressure $P_a$ in the converter, and the desired velocity (the Mach number $M_{am}$) at mouth 5 of blast pipe 1. The (calculated) pressure $P_o$, which must be present at the inlet of the Laval tube is compared in comparator 44 to the actual pressure P measured by receptor 30, and the difference is applied to a regulator 45, which acts on valve 22. The inputs to generator 43 are the pressure $P_o$ which must be present at the inlet of the Laval tube, the desired nominal flow $Q_n$, and the temperature $T_o$ at the inlet of the Laval tube. The calculated throat area is compared in comparator 46 to the actual throat area measured by means of the needle position receptor 31, and the difference is applied to a regulator 47 which acts on the relative position of needle 23. The comparator 40 compares the outlet pressure of the jet to the ambient pressure $P_a$ in the conventer, and acts on regulator 41, so as to nullify any pressure difference. The various regulators are preferably of the type commercially sold as "Kalman optimal regulator".

Figure 3:
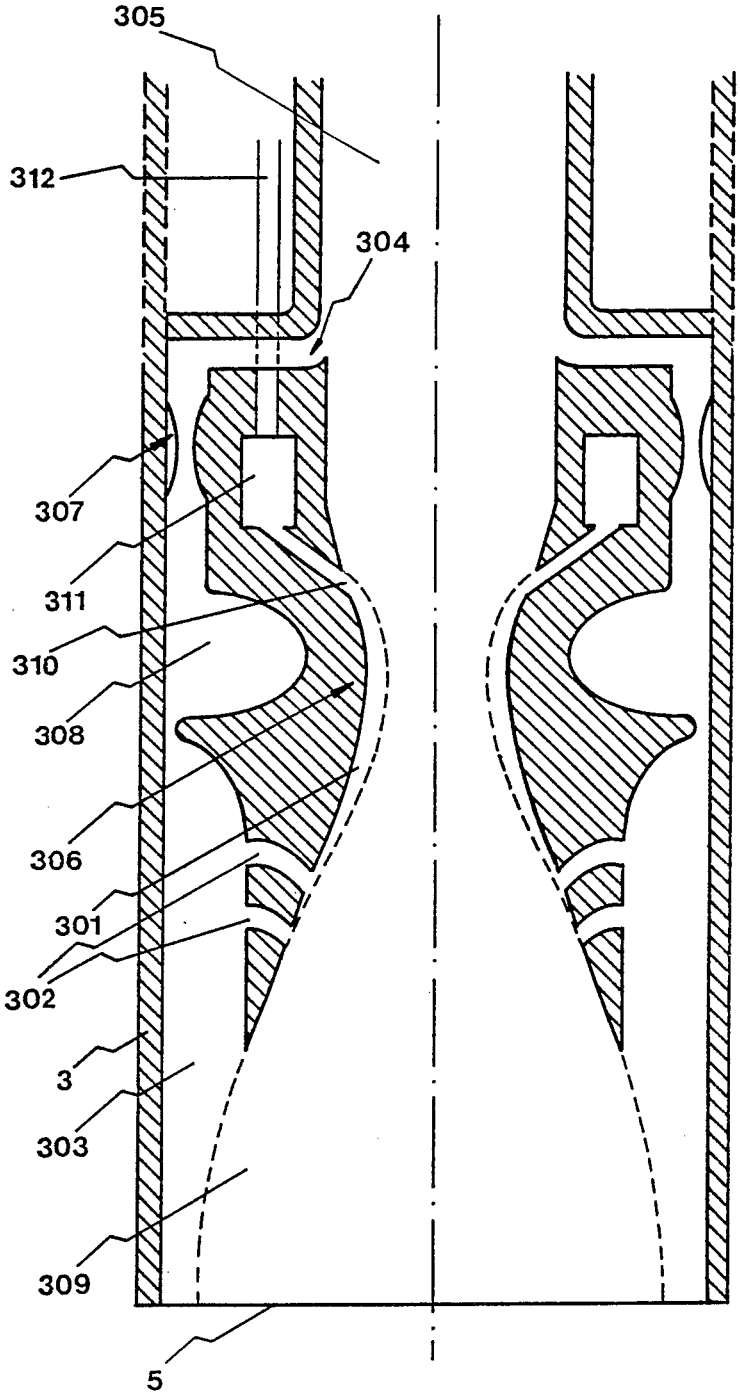
FIG. 3 is a cross sectional elevation view of a second embodiment of a nozzle in accordance with the present invention.

In FIG. 3, a cross sectional view of another embodiment of the variable blast pipe of the present invention is shown which has no moving parts. It will be appreciated that the cooling system is not represented. In FIG. 3, the variable-position needle is replaced by a subsonic coaxial gaseous flow 301 injected at a pressure slightly greater than the local static pressure of the central jet. This subsonic "ring" has its source in an annular opening 310 machined in the convergent portion of a Laval tube 306, and connected to a toric pressure equalization chamber 311. Chamber 311 is supplied, through a duct 312, with a pressure which is a function of the magnitude of the desired subsonic ring 301. It will be appreciated that any gas may be chosen which does not react chemically with central jet 305, preferably oxygen or air. Subsonic ring 301 is eliminated, after passage through the throat, through a porous divergent portion, with holes 301 machined so as to form a supersonic "filter", (i.e., they are "transparent" for subsonic flow, and nonexistent for a supersonic flow), due to properties of expansion and supersonic compression. The quantity of gas which reunites with the annular subsonic jet 303 is small, so as not to appreciably disturb this jet.

The expansion of supersonic central jet 309 to the ambient pressure takes place in a subsonic annular jet 303 whose flow is limited by an annular Laval tube 307 upstream of a cavity 308 which acts as an accumulator. This assembly essentially constitutes an expansion regulating system.

The gas forming the annular jet 303 originates from a withdrawal of gas from central jet 305 upstream of Laval tube 306. The quantity of gas withdrawn is negligible with respect to the quantity of gas carried by central jet 305. The inlet pressure of annular Laval tube 307 follows the variations in pressure of the central jet; which are strongly damped by the combined action of annular Laval tube 307 and cavity 308 acting as an accumulator. The dimensions of the annular Laval tube and of the cavity are selected as a function of the operating region of the supersonic jet, as explained above with regard to valve 4 (FIG. 2). In particular, it is necessary to ensure in the area downstream of the accumulator, a static pressure lower than that of the supersonic central jet.

Figure 4:
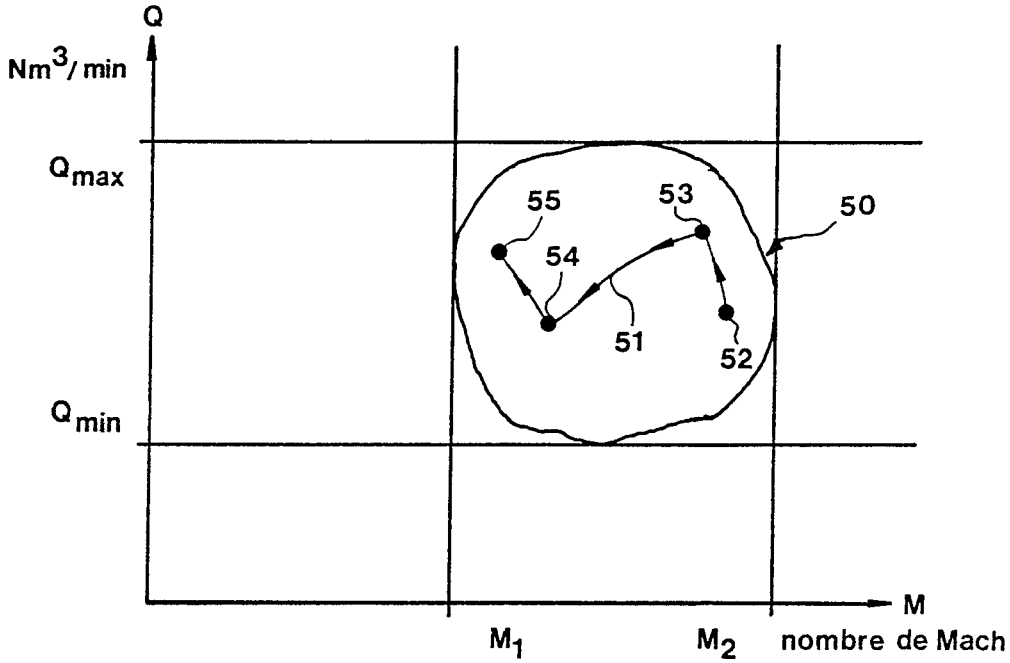
FIG. 4 is a diagram of an example of the velocity/-flow rate characteristic of an oxygen jet in accordance with the present invention.

In FIG. 4, a graphical representation (relative to flow and velocity characteristics), of an oxygen blasting jet incorporating the nozzle in accordance with the present invention is shown. On the abscissa is the Mach number, and on the ordinate is the oxygen flow Q in $Nm^3/min$ exiting from blast pipe 1. As a function of the geometric dimensions of blast pipe 1 (area of the duct upstream of the blast pipe, trend of the convergence, maximum and minimum areas of the throat, distance to the mouth, etc.) there is a region 50 within which the modalities of functioning of the nozzle are optimal. It will be appreciated that one could move outside this region, for example to obtain a Mach number significantly greater than $M_2$, by greatly increasing the pressure upstream of the convergence. However, in that case there would also be high energy losses (notably shock waves). In region 50, there is also represented an example of a path swept out during the blasting process, with different operating states 52, 53, 54 and 55 corresponding to well-defined refining phases. It is apparent that instead of implementing a system such as is represented in FIG. 2, which permits operation of the nozzle in an optimal manner for any operating state included within region 50, it would be possible, by simple testing, to determine the relatively few operating states (e.g. 52, . . . ,55) normally needed in the course of refining, and to utilize only those few operating states.

The invention has been presented using outer and inner tubes of essentially cylindrical form. It will be appreciated that any form (e.g. oval) of tube which gives rise to the Laval relationship may be utilized. Similarly, instead of utilizing a needle (as in the FIG. 1 embodiment) or gaseous "belt" (as in the FIG. 3 embodiment), any other means of achieving the intended variation in the effective area of the throat of lower portion 21 may be used.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A nozzle for the refining of metals or ferroalloys by oxygen blasting from above the melt, the nozzle including a nozzle head, the nozzle head having at least one blast pipe therethrough for delivering jets of gas, the gas being at least partly composed of oxygen wherein the blast pipe comprises:

an inner duct having a lower portion, said lower portion including a throat between a convergent section and a divergent section, said convergent section being upstream of said divergent section and said divergent section terminating at the mouth of the inner duct wherein said convergent section, throat and divergent section define a laval nozzle and wherein said inner duct mouth is spaced upstream from the mouth of said blast pipe;

an outer duct coaxial to said inner duct and having a greater cross section than said inner duct, said outer duct terminating at the mouth of said blast pipe;

means for varying the cross sectional area of said throat of said inner duct;

flow control valve means associated with said inner duct; and means associated with said outer duct to limit the velocity of gas flowing therethrough to subsonic speeds.

2. The nozzle according to claim 1, wherein said means to vary the area of said throat comprise:

a needle-shaped member, said member being movable along the longitudinal axis of said inner duct wherein the point of said needle-shaped member is adapted to be positioned at a plurality of locations within said throat of said inner duct.

3. The nozzle according to claim 1 wherein said means to vary the area of said throat comprises:

an annular opening in said convergent section of said inner duct, said annular opening communicating with a source of gas under variable pressure.

4. The nozzle according to claim 3 wherein:

said annular opening is comprised of a plurality of spaced elements, said elements being spaced by portions of the wall forming the convergent section

5. The nozzle according to claim 3 wherein:

said divergent section has supersonic filter means therein, said filter means connecting said inner duct to said outer duct.

6. The nozzle according to claim 5 wherein:

said supersonic filter means is comprised of openings machined in said wall of said divergent section.

7. The nozzle according to claim 1 wherein said means to limit the velocity of the gas flowing in said outer duct to subsonic speeds comprises:

valve means with a variable opening.

8. The nozzle according to claim 1 wherein said means to limit the velocity of the gas flowing in said outer duct to subsonic speeds comprises:

an annular Laval tube attached to a cavity.

9. The nozzle according to claim 1 wherein:

said mouth of said inner duct is spaced about ten centimeters upstream from said mouth of said blast pipe.

10. The nozzle according to claim 1 wherein:

said cross sectional area of said inner tube is at least 50% and at most 90% of the cross sectional area of said outer tube.

* * * * *